US006105414A

United States Patent [19]

Yamada et al.

[11] Patent Number: 6,105,414

[45] Date of Patent: Aug. 22, 2000

[54] TRANSFER FEEDER FOR FORGING PRESS

[75] Inventors: Ryoichi Yamada; Kouichi Kondo; Akihiro Ukita, all of Niihama, Japan

[73] Assignee: Sumitomo Heavy Industries, Ltd., Tokyo, Japan

[21] Appl. No.: 09/221,146

[22] Filed: Dec. 28, 1998

[30] Foreign Application Priority Data

Jan. 5, 1998 [JP] Japan ..... 10-011929

[51] Int. Cl.[7] ..... B21D 43/05

[52] U.S. Cl. ..... 72/405.16; 72/405.01; 72/405.12

[58] Field of Search ..... 72/405.16, 405.13, 72/405.12, 405.09, 405.01; 198/621.1

[56] References Cited

U.S. PATENT DOCUMENTS

| | | | |
|---|---|---|---|
| 3,760,957 | 9/1973 | Berger | 72/405.16 |
| 4,511,029 | 4/1985 | Okawa | 72/405.13 |
| 4,811,834 | 3/1989 | Asano | 72/405.13 |
| 5,267,463 | 12/1993 | Doyama | 72/405.16 |
| 5,488,852 | 2/1996 | Nishikawa | 72/405.13 |

*Primary Examiner*—Daniel C. Crane
*Attorney, Agent, or Firm*—Arent Fox Kintner Plotkin & Kahn, PLLC

[57] ABSTRACT

A transfer feeder for a forging press includes a pair of parallel feed bars each having article-grasping claws, the feed bars being able to make a three-dimensional movement (i.e., an advance-return movement of the feed bars in a longitudinal direction, a clamping-unclamping movement of the feed bars in a widthwise direction, and a lift-down movement of the feed bars) so as to feed forging workpieces from one step of a pressing process to another. The transfer feeder further includes lift-down devices each for making a lift-down movement relative to a corresponding transfer frame through a lift-down linear-movement mechanism, advance-return devices each for making an advance-return movement relative to a lift-down frame of the associated lift-down device through an advance-return linear movement mechanism, and clamping-unclamping devices each for making a clamping-unclamping movement relative to an advance-return frame of the advance-return device through a clamping-unclamping linear-movement mechanism. The advance-return devices respectively include advance-return drive portions which are provided adjacent respectively to opposite ends of the feed bars so as to feed the feed bars in the same direction in synchronism with each other. The lift-down devices, as well as the advance-return devices, and the clamping-unclamping devices, are mounted respectively within the transfer frames which are provided adjacent respectively to the opposite ends of the feed bars, and are disposed at a level higher than the feed bars.

1 Claim, 6 Drawing Sheets

TRANSFER FEEDER FOR FORGING PRESS

BACKGROUND OF THE INVENTION

1. Field of the Invention

This invention relates to a transfer feeder for a forging press, which is provided on the forging press, and grasps forging workpieces, and feeds them from one step of a pressing process to another.

2. Related Art

One known apparatus for feeding workpieces from one step of a press-forging process to another is a transfer feeder having a pair of parallel feed bars. The two parallel feed bars have a plurality of opposed claw members for grasping the workpieces from opposite sides. The two feed bars are moved toward each other in parallel relation to each other to hold the workpieces therebetween, and then are moved upward to remove the workpieces from a lower die, and then are moved forward (or advanced) in an axial direction, and then are again moved downward, and then are moved away from each other, thus transferring the workpieces to the next step, and thereafter the two feed bars are returned respectively to their original positions. This operation is repeated.

One known conventional transfer feeder for enabling the above three-dimensional movement of the feed bars comprises servo motors, and feed screw mechanisms. For example, in an automatic transfer apparatus for a forging press, disclosed in Japanese Patent No. 2,560,970, an upwardly-downwardly-moving carriage is provided adjacent to one ends (rear ends) of feed bars, and is moved upward and downward by a lift-down servo motor and a feed screw, and an advance-return carriage (left-right moving carriage) and an advance-return servo motor are mounted on this upwardly-downwardly-moving carriage, and the advance-return carriage is advanced and returned, together with the feed bars by a feed screw, and the feed bars are supported on the advance-return carriage for movement toward and away from each other so as to effect a clamping-unclamping operation, and a clamping-unclamping servo motor is mounted on the advance-return carriage, and a feed screw, connected to this servo-motor, is threadedly engaged with the feed bars so as to move the feed bars toward and away from each other (that is, so as to effect the clamping-unclamping operation).

At a position adjacent to the other ends (front ends) of the feed bars, the lift-down movement and the clamping-unclamping movement are also effected by servo motors and feed screws of a similar construction described above for the above construction provided adjacent to the rear ends of the feed bars. However, any drive portion for effecting the advance-return movement is not provided adjacent to the front ends of the feed bars, and the end portions of the feed bars are inserted in a clamping-unclamping slider portion for sliding movement in an axial direction. The foregoing is an ordinary example of feed bar-moving mechanism comprising the servo motors and the feed screws, and the advance-return drive mechanism (including the feed screw) and the clamping-unclamping drive mechanisms (including the feed screws) are disposed at a level generally equal to the feed bars, and the feed bars are placed directly on the advance-return carriage, and besides a lower end portion of the lift-down feed screw extends downwardly through the lift-down carriage to a level lower than the feed bars, and is journalled in a suitable fixing frame.

As described above, in the conventional transfer feeder of the screw feed-type, the driving in the advance-return direction is effected only by one drive motor provided adjacent to one ends of the long feed bars, and the longer the feed bars, the larger the load on the motor, and besides it is difficult to achieve the high-speed, precise operation. Furthermore, the drive portions and the sliding movement-support portions are disposed at the same level of the feed bars, and in order to protect the sliding portions from scales, produced during a pressing operation, and lubricant for a dies, the sliding portions are covered with bellows. With this construction, however, the bellows are expanded and contracted while being exposed to the heat of the workpieces, the scales and the lubricant for the die, and therefore are liable to be deteriorated and damaged, so that the scales and so on intrude into the sliding portions. As a result, the sliding portions are subjected to premature wear, and cause vibrations, so that the feed bars can not be smoothly fed from one step to another, and therefore the inspection, repair and exchange must be effected frequently.

And besides, that portion of a transfer frame, at which the drive portions are provided, is disposed at a level lower than the feed bars, and this narrows a space for installing a charging-discharging device. Furthermore, cylinders for exchanging the feed bars are mounted on a press bed, and this is liable to cause various troubles, and besides when exchanging the feed bars, the feed bars are lifted, and this limits a space for a bolster.

SUMMARY OF THE INVENTION

It is an object of this invention to provide a transfer feeder for a forging press which overcomes the above problems of the prior art, and in which sliding portions are disposed at a higher level so that they are less liable to be affected by scales and lubricant for a die, thereby enhancing their durability, and also a large space for installing a charging-discharging device can be secured.

Another object of the invention is to provide a transfer feeder for a forging press, in which drive sources for feeding feed bars in an advance-return direction are provided adjacent respectively to front and rear ends of the feed bars, thereby achieving the high-speed performance and the smooth feed performance, and there is provided means for preventing damage to the feed bars and their neighboring portions, which damage is caused by the difference in the timing of the operation between the moving mechanisms, provided adjacent respectively to the opposite ends of the feed bars, and particularly by an error in the synchronizing operation of the two advance-return feed mechanisms.

A further object of the invention is to provide a transfer feeder for a forging press in which the operation for changing the stage, as well as the operation for exchanging the feed bars, is easy, and the operability is enhanced so that the automatic exchange can be effected by a remote control.

According to the present invention, there is provided a transfer feeder for a forging press comprising:

a pair of parallel feed bars each having article-grasping claws, the feed bars being able to make a three-dimensional movement so as to feed forging workpieces from one step of a pressing process to another, and the three-dimensional movement including an advance-return movement of the feed bars in a longitudinal direction, a clamping-unclamping movement of the feed bars in a widthwise direction, and a lift-down movement of the feed bars;

lift-down devices each for making a lift-down movement relative to a corresponding transfer frame through a lift-down linear-movement mechanism;

advance-return devices each for making an advance-return movement relative to a lift-down frame of the associated lift-down device through an advance-return linear movement mechanism; and clamping-unclamping devices each for making a clamping-unclamping movement relative to an advance-return frame of the advance-return device through a clamping-unclamping linear-movement mechanism;

wherein the advance-return devices respectively include advance-return drive portions which are provided adjacent respectively to opposite ends of the feed bars so as to feed the feed bars in the same direction in synchronism with each other; and wherein the lift-down devices, as well as the advance-return devices, and the clamping-unclamping devices, are mounted respectively within the transfer frames which are provided adjacent respectively to the opposite ends of the feed bars, and are disposed at a level higher than the feed bars.

DESCRIPTION OF THE PREFERRED EMBODIMENT

Figure 1:
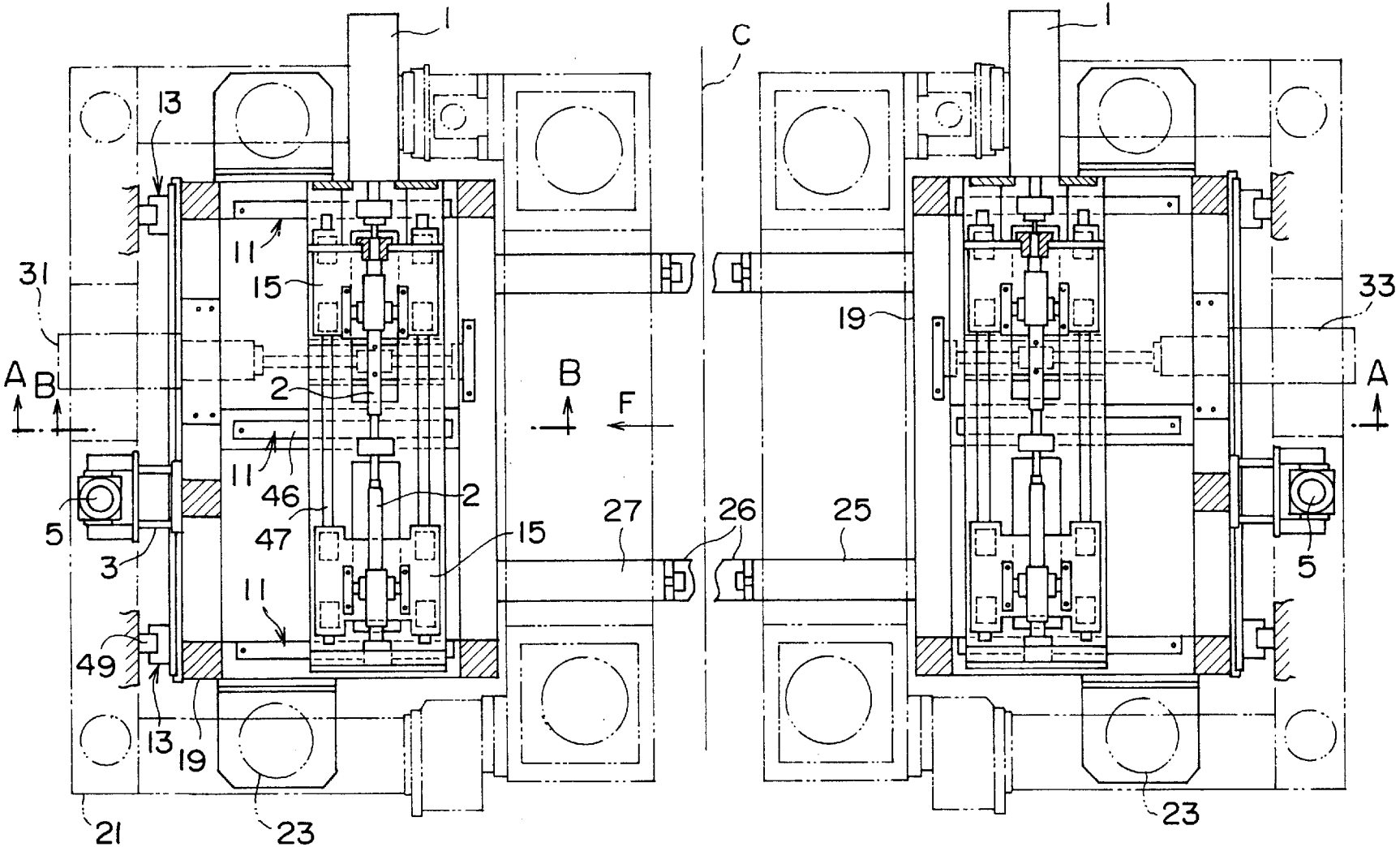
FIG. 1 is a plan view of one preferred embodiment of a transfer feeder of the present invention for a forging press.
Figure 2:
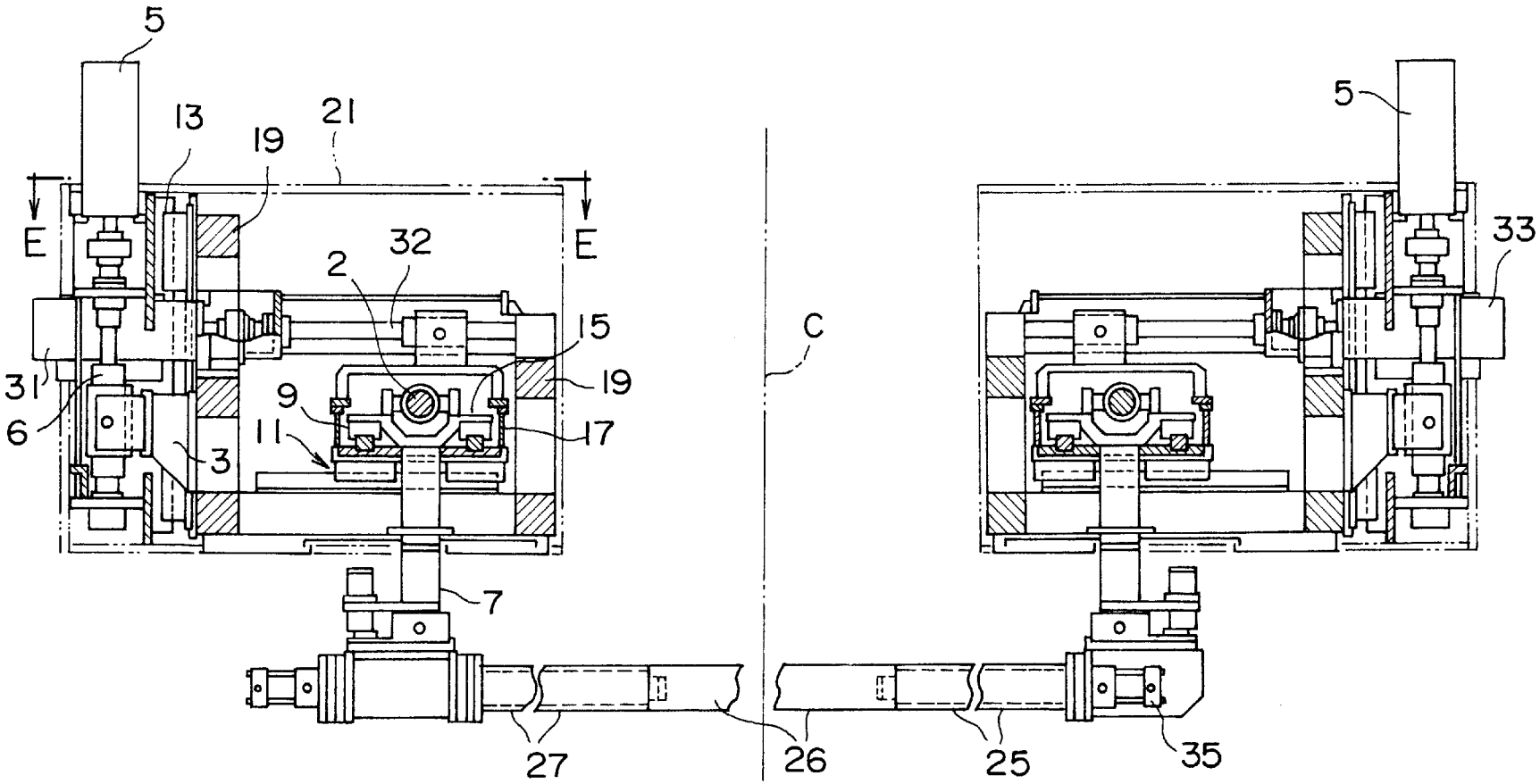
FIG. 2 is a cross-sectional view taken along the line A—A of FIG. 1 as seen from the front side.
Figure 7:
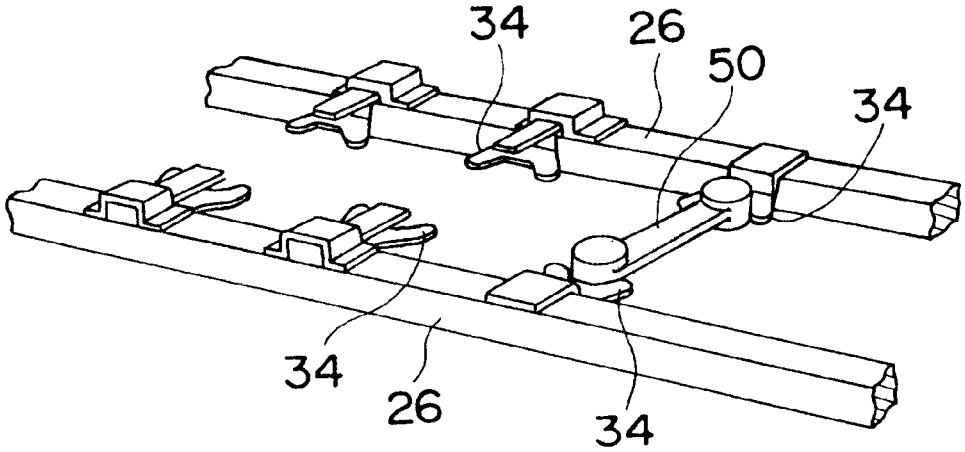
FIG. 7 is a perspective view showing the feed bars, having article-grasping claws, and a forged product grasped by the article-grasping claws.

A preferred embodiment of the present invention will now be described with reference to the drawings. As described above, in a transfer feeder of this kind, feed bars make a lift-down movement (upward-downward movement), an advance-return movement (forward-backward movement), and a clamping-unclamping movement (opening-closing movement). However, in order to avoid redundancy, the lift-down movement will be hereinafter referred to as the lift movement, the advance-return movement as the advance movement, and the clamping-unclamping movement as the clamping movement unless this is particularly inappropriate. FIG. 1 is a plan view of one preferred embodiment of a transfer feeder of the present invention for a forging press, and FIG. 2 is a cross-sectional view taken along the line A—A of FIG. 1 as seen from the front side. A pair of feed bars extend in a direction (indicated by arrow F) of feed of forged articles or products, and each of the feed bars comprises a left bar 27, an intermediate bar 26, and a right bar 25, and the intermediate bar 26 can be removed from the left and right bars 27 and 25 as will be more fully described later. As shown in FIG. 7, article-grasping claws 34 for grasping the forged articles 50 are mounted on the intermediate bar 26. In FIGS. 1 and 2, each intermediate bar 26 is shown as broken intermediate its opposite ends, and therefore the grasping claws 34 are not shown. Transfer frames 21 are disposed near respectively to left and right ends of the feed bars, and extend upwardly to assume a frame-like configuration. A lift frame 19 (more fully described later) is received within this transfer frame 21. Lift-down devices, as well as advance-return devices and clamping-unclamping devices, are provided adjacent respectively to the opposite ends of the feed bars, and are arranged symmetrically with respect to a transverse central line C of the transfer feeder, and therefore that portion of the transfer feeder, disposed at one ends of the feed bars located in the direction of feed, will be described below.

Figure 3:
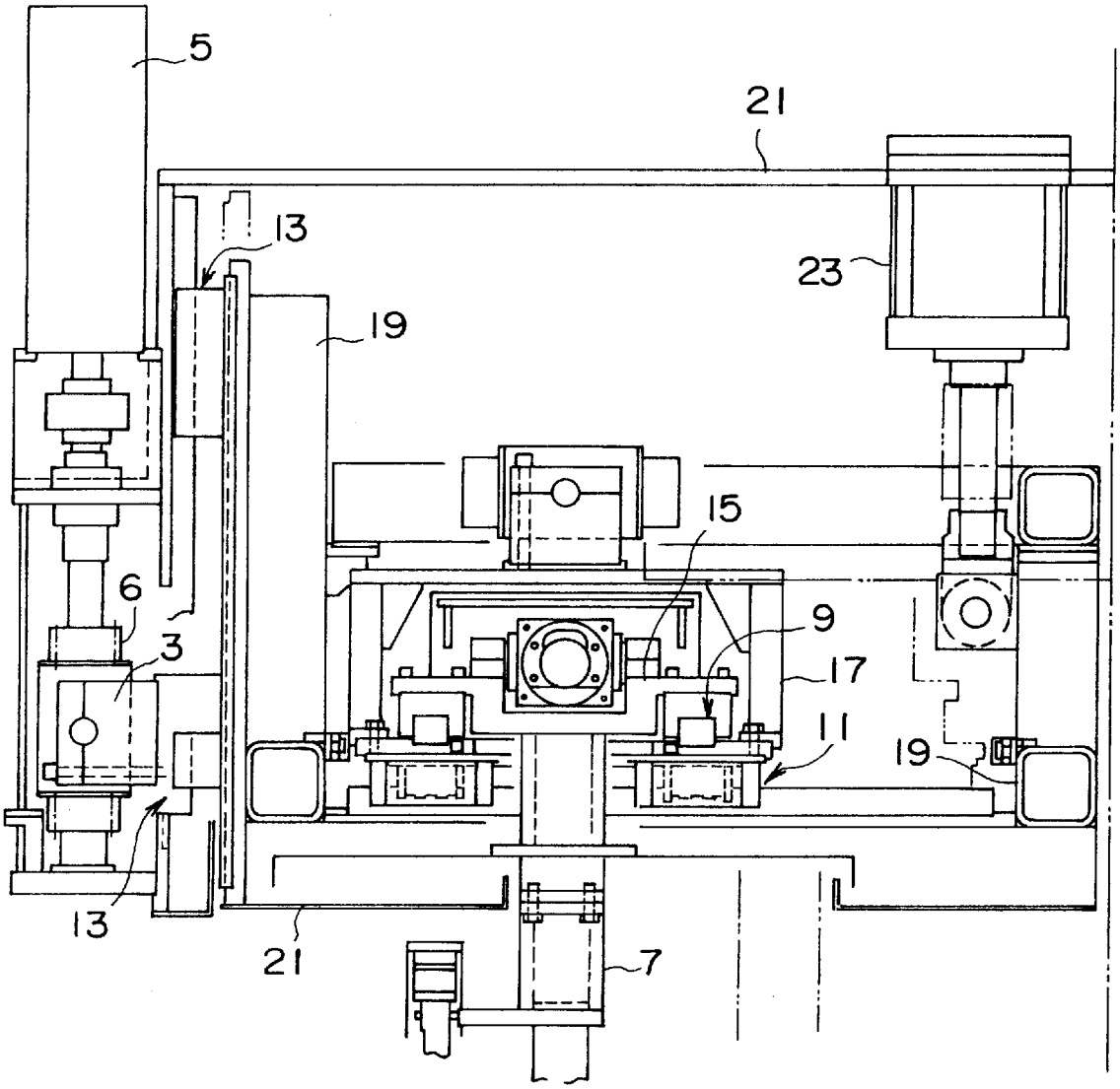
FIG. 3 is an enlarged, cross-sectional view taken generally along the line B—B of FIG. 1.
Figure 4:
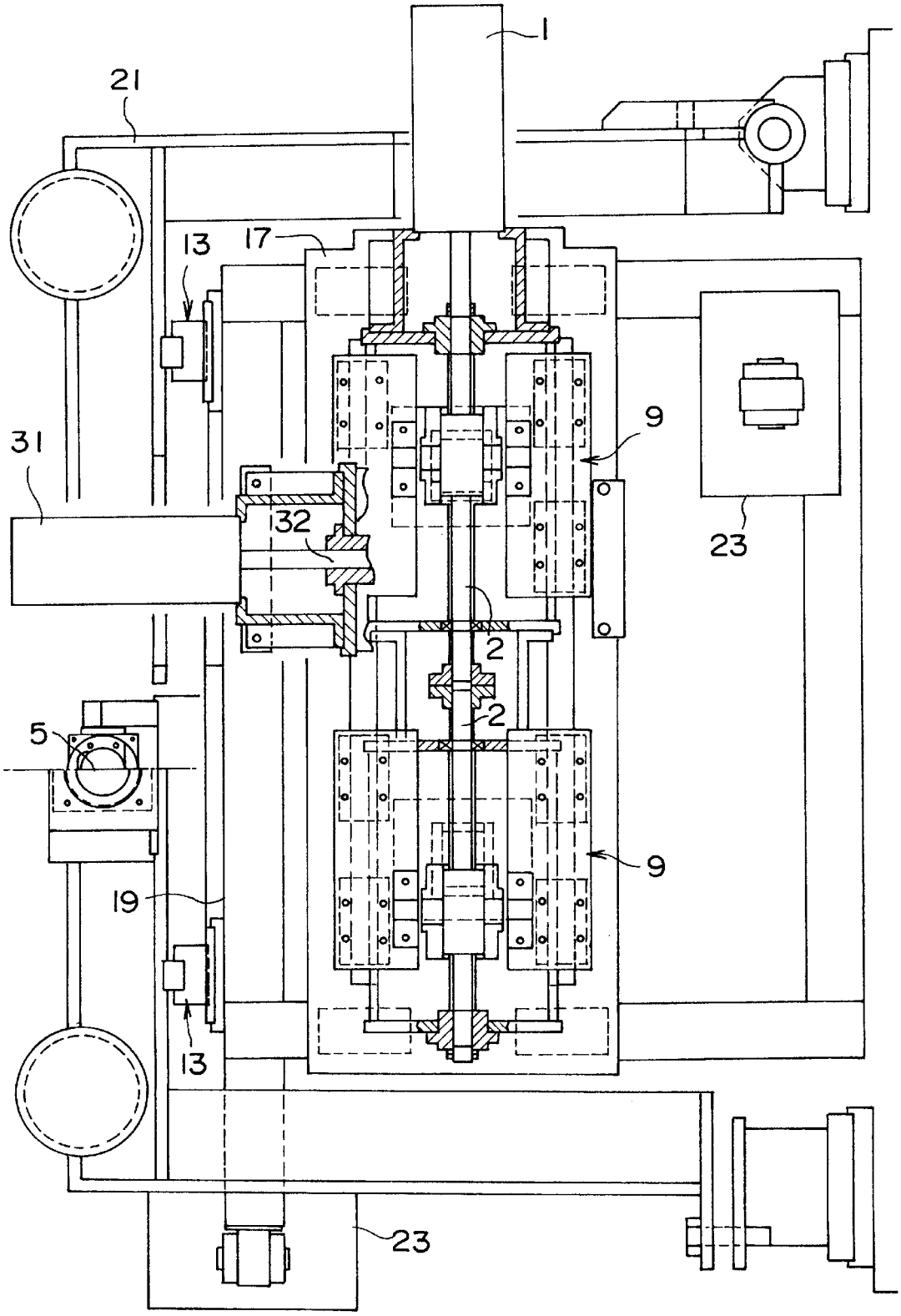
FIG. 4 is an enlarged, plan view taken generally along the line E—E of FIG. 2, with some portions shown in cross-section.
Figure 5:
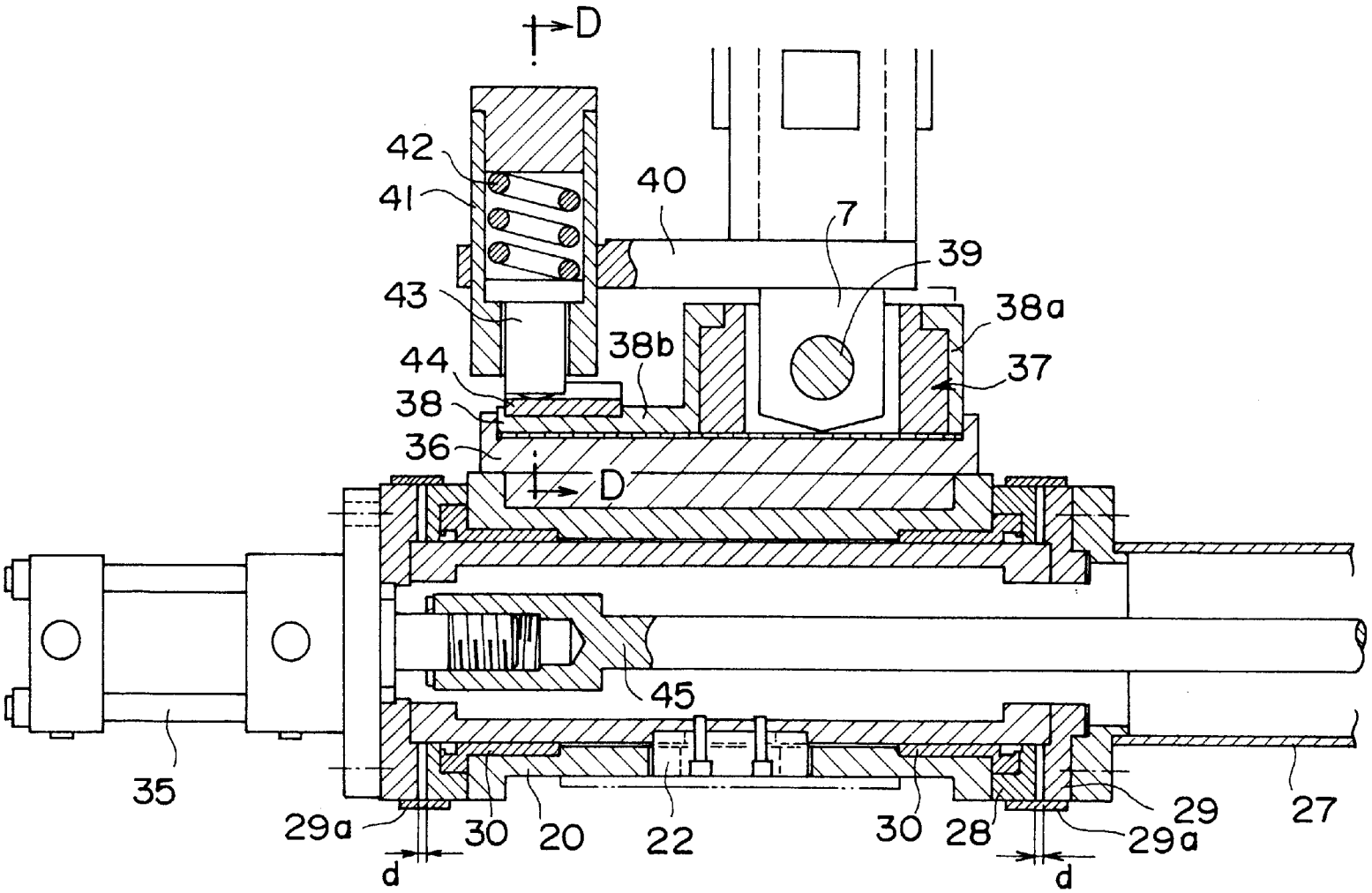
FIG. 5 is an enlarged, cross-sectional view showing a connecting portion interconnecting a feed bar and a feed bar support rod.
Figure 6:
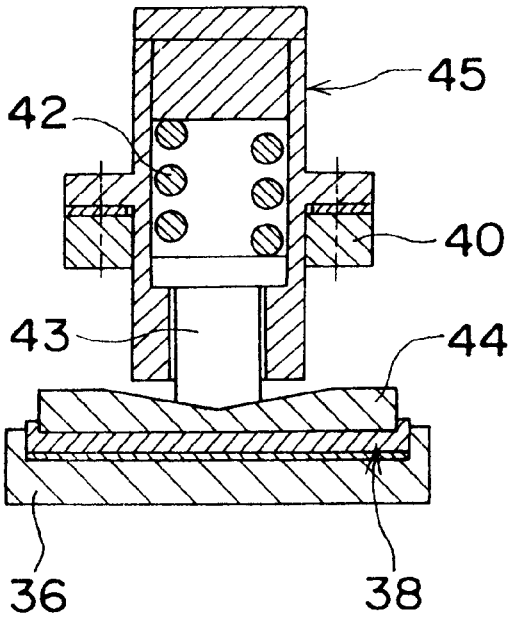
FIG. 6 is a cross-sectional view taken along the line D—D of FIG. 5.

FIG. 3 is an enlarged, cross-sectional view (as seen from the front side) taken generally along the line B—B of FIG. 1, and FIG. 4 is an enlarged, plan view taken generally along the line E—E of FIG. 2, with some portions shown in cross-section. Referring to FIGS. 1 to 4, a lift motor 5 is mounted at an upper portion of the transfer frame 21, and a lift ball thread 6 of lift linear-movement units 13 is connected to an output shaft of the lift motor 5. The lift ball thread 6 is threadedly engaged with a ball thread nut mounted on a bracket 3 projecting from the lift frame 19, and when the lift motor 5 is driven, the whole of the lift frame 19 is moved upward and downward through the lift linear-movement units 13 (e.g. linear guides) provided between the lift frame 19 and the transfer frame 21. In FIG. 1, reference numeral 49 denotes a rail of the lift linear-movement unit 13.

As shown in FIG. 1, three bottom members are provided at a lower portion of the lift frame 19, and extend in the direction of extending of the feed bars, and guide rails of advance linear-movement units 11 are fixedly mounted respectively on these bottom members. Referring to FIGS. 2 and 3, an advance frame 17 is received within the lift frame 19, and sliders of the advance linear-movement units 11, which are held in sliding engagement with the above guide rails, respectively, are mounted on the bottom of the advance frame 17. An advance motor 31 is mounted on one side of the lift frame 19 disposed in the longitudinal direction of the feed bars, and an advance ball thread 32 is connected to an output shaft of the advance motor 31. The same construction is provided for a right-hand advance motor 33. The advance ball thread 32 is threadedly engaged with a ball thread nut projecting from an upper portion of the advance frame 17. When the advance motors 31 and 33 are driven, each of the advance frame 17 moves forward and backward (that is, advances and returns) relative to the lift frame 19 through the advance linear-movement units 11. The advance motors 31 and 33, provided at the front (left) side and rear (right) side in the direction of feed of the workpiece, are operated in synchronism with each other, so that the left and right advance frames 17 simultaneously advance and return. In FIG. 1, reference numeral 46 denotes a rail of the advance linear-movement unit 11.

Feed bar support rods 7 are fixedly mounted respectively on the opposite ends of the feed bars, and extend vertically upwardly therefrom. The support rod 7 extends into the transfer frame 21 through the lower side thereof, and an upper end of the support rod 7 is received within the advance frame 17, and a clamp frame 15 is fixedly secured to this upper end. The clamp frame 15 is supported on the advance frame 17 through clamp linear-movement units 9 provided between a lower surface of the clamp frame 15 and an inner bottom surface of the advance frame 17, and the clamp frame 15 is movable, together with the support rod 7, in a clamping-unclamping direction. In FIG. 1, reference numeral 47 denotes a rail of the clamp linear-movement unit.

As shown in FIGS. 1 and 4, a clamp motor 1 is mounted on one side portion of the transfer frame 21. A ball thread 2 is connected to an output shaft of the clamp motor 1, and the ball thread 2 has a proximal ball thread portion (close to the output shaft) and a distal ball thread portion (the boundary between the proximal and distal ball thread portions is disposed at a generally central portion of the ball thread 2), and the direction of threads on the proximal ball thread portion is reverse to the direction of threads on the distal ball thread portion. Ball thread nuts, threaded respectively on the ball thread portions, are fixedly secured respectively to the clamp frames 15 fixedly secured respectively to the upper ends of the support rods 7 fixedly mounted respectively on the opposite ends of the pair of feed bars. Therefore, when each clamp motor 1 is driven, the clamp frames 15 are slidingly moved over the advance frame 17 through the clamp linear-movement units 9 by the thread-feed operation of the ball thread of the clamp linear-movement units 9, so that the pair of feed bars are moved toward (for the clamping operation) and away from (for the unclamping operation) each other through the support rods 7.

When the advance motors 31 and 33 are energized, each advance frame 17 advances and returns relative to the lift frame 19 in the direction of the length of the feed bars through the threading operation of the advance ball thread 32, so that the feed bar support rods 7, each held on the advance frame 17 through the clamp linear-movement units 9 and the clamp frame 15, and hence the feed bars, advance and return. At this time, the clamp motor 1 and the clamp frames 15, provided on the advance frame 17, are moved together with the advance frame 17 in the direction of the length of the feed bars.

The clamping and unclamping movements and the advance and return movements are horizontal movements. However, with respect to the lift-down movement, the weight of the lift frame 19 acts on the lift linear-movement units 13, and therefore balancing cylinders 23 (which may be replaced by pneumatic springs), utilizing the air pressure, are provided between the transfer frame 21 and the lift frame 19. In the illustrated embodiment, the pneumatic cylinders 23 are mounted on the transfer frame 21, and distal ends of piston rods, always urged upward by the air pressure within the cylinders 23, are pivotally connected to the lift frame 19, and with this construction, the upward and downward movements can be effected smoothly without applying an undue force to the lift linear-movement units 13.

When each lift motor 5 is energized, the lift frame 19 is moved upward and downward through the threading operation of the lift ball thread 6 of the lift linear-movement units 13, so that the advance frame 17 is moved upward and downward through the advance linear-movement units 11 held on the lift frame 19, and at the same time the clamp frames 15 and the feed bar support rods 7 are moved upward and downward through the clamp linear-movement units 9, and therefore the feed bars are moved upward and downward.

In the present invention, various safety devices are provided for preventing the feed bars, the article-grasping claws and other portions of the mechanisms from being damaged during the advance-return movement, the clamping-unclamping movement and the lift-down movement. For effecting the advance movement, the drive devices (i.e., the advance motors 31 and 33), provided adjacent respectively to the opposite ends of the feed bars, are driven in synchronism with each other, and with this construction, the high-speed performance is secured, and also the load, acting on the motors 31 and 33, is reduced. However, for some reason, if the timing of operation of the advance motor 31 becomes different from that of the advance motor 33, or if the amount of feed by the motor 31 becomes slightly different from that of the motor 33, an desirable axial force acts on the feed bars. Therefore, in the present invention, a sleeve 20 is mounted on the outer periphery of one of the front (left) and rear (right) end portions of each feed bar, and the feed bar support rod 7 is connected to the sleeve 20.

The sleeve 20 is guided by bushings 30, and is mounted on the feed bar for sliding movement relative to the feed bar in the axial direction, but the sleeve 20 is prevented by a slide key 22 from rotation relative to the feed bar. End plates 28 are mounted on opposite ends of the sleeve 20, respectively. Outer flanges 29 are fixedly mounted on the outer periphery of the feed bar, and each of the opposite end plates 28 is spaced a small gap d from the corresponding outer flange 29 in opposed relation thereto. The gap d allows a relative movement in the advance direction between the sleeve 20 and the feed bar. More specifically, if the amounts of feed of the feed bars by the advance motors 31 and 33 are different from each other during the advance-return movement, each sleeve 20, connected to the support rod 7, is slightly moved in the axial direction along guide surfaces of the bushings 30 in the range of the above gap d, and the difference between the feed amounts is absorbed by this relative movement between the sleeve 20 and the feed bar, and therefore the feed bars and the support rods 7 are prevented from being damaged during the advance movement. Each of the gaps d is covered by a cover 29*a* fixedly secured at one end thereof to the associated outer flange 29.

A tubular member 37 is disposed on the upper side of the sleeve 20 through a suitable plate member 36. An outer shell member 38 is fixedly secured to the plate member 36, and this outer shell member 38 has an outer tubular portion 38*a*, surrounding the outer periphery of the tubular member 37, and a flat bottom plate portion 38*b* fixed to the plate member 37. The outer tubular portion 38*a* of the outer shell member 38 and the tubular member 37 are slidingly rotatable relative to each other. The lower end portion of the feed bar support rod 7 is inserted in the tubular member 37, and the tubular member 37 and the support rod 7 are connected together by a horizontal pin 39. This pin 39 does not extend through the outer tubular portion 38*a* of the outer shell member 38.

As shown in the drawings, a spring cylinder 41 is mounted on the lower end portion of each feed bar support rod 7 through a bracket 40. A compression spring 42 is received within the spring cylinder 41, and a piston 43 of the spring cylinder 41 is urged by this spring force to project downwardly from the spring cylinder 41. A positioning seat member 44, having a gently-recessed central portion, is fixedly secured to the bottom plate portion 38*b* of the outer shell member 38, and is disposed beneath the piston 43. The lower end of the piston 43 is always pressed against the central recessed portion of the seat member 44 under the influence of the compression spring 42 received within the cylinder 41. The outer shell member 38, the tubular member 37, the pin connection construction by which the tubular member 37 and the support rod 7 are connected together, the spring cylinder 41, and the positioning seat member 44 are provided at each of the opposite ends of each feed bar.

For some reason (such as some trouble), during the clamping and unclamping operation, if the amount of movement of any of the support rods 7, provided respectively at the opposite ends of the feed bars, in the clamping direction is different from a predetermined value, or if the synchronizing operation is not effected properly, the outer shell member 38 is slidingly rotated about the axis of the support rod 7 relative to the tubular member 37 against the pressing force of the piston of the spring cylinder 41, and as a result the feed bar, connected the outer shell member 38, is angularly moved relative to the feed bar support rod 7 in a horizontal plane, and therefore the amount of displacement of the support rod 7 from the proper position in the clamping direction is absorbed, thereby preventing damage to the feed bar during the clamping operation. When the amount of displacement of the feed bar support is eliminated, the distal end of the piston 43 of the spring cylinder 41, held in engagement with the seat member 44, slides over a tapering surface of the seat member 44 to be returned to the central portion of the seat member 44.

For some reason (e.g. some trouble), during the lift-down operation, if the amount of movement of any of the support rods 7, provided respectively at the opposite ends of the feed bars, in the lifting direction is different from a predetermined value, or if the synchronizing operation is not effected properly, the tubular member 37, connected to the feed bar support rod 7 through the pin 39, is angularly moved about the axis of the pin 39 against the pressing force of the piston of the spring cylinder 41, so that the feed bar is tilted or turned upward or downward relative to the support rod 7, thereby preventing damage to the feed bar during the lift operation.

The whole of each of the feed bars is hollow, and intermediate bar-connecting rods 45 are inserted respectively in the left and right bars 27 and 25 of each feed bar, and extend generally coaxially therewith. One ends of the intermediate bar-connecting rods 45 are connected respectively to piston rods of intermediate bar-connecting cylinders 35 provided respectively at the outer ends of the left and right bars 27 and 25, and the other end portions of the connecting rods 45 are removably fitted respectively in opposite end portions of the hollow intermediate bar 26. For removing the intermediate bar 26, the connecting cylinders 35 are operated to retract their piston rods, and as a result the intermediate bar-connecting rods 45 are withdrawn respectively from the opposite end portions of the intermediate bar 26, so that the intermediate bar 26 can be removed.

In the above embodiment, although the drive sources for the lift-down operation, the clamping-unclamping operation and the advance-return operation are constituted by AC servo motors, the present invention is not limited to this construction, and for example, there may be used hydraulic servo motors which comprises a hydraulic cylinder with a position detection function, and a servo valve.

As described above, in the present invention, the sliding portions of the moving mechanisms for effecting the three-dimensional movement of the feed bars are provided at the positions higher than the level of the feed bars, and are received within the transfer frame. Therefore, the various portions of the mechanisms, and particularly the sliding portions will not be affected by scales, produced during a hot pressing step, lubricant for dies, and the heat of the workpiece to be shaped, and the durability thereof is enhanced, and besides since the various portions of the mechanisms are disposed at the upper positions, a space for installing a charging-discharging device can be secured, and also the maintenance efficiency is enhanced.

There is no need to provide any drive device for retracting and connecting the feed bars when changing the stage, and the feed bars can be exchanged merely by operating the cylinders provided adjacent respectively to the opposite ends of the feed bars, and the enhanced operability is obtained, and also a large space is obtained over a press bed.

In the present invention, the two drive portions for advancing and returning the feed bars are provided adjacent respectively to the opposite ends of the feed bars, and the two drive portions are driven in synchronism with each other to feed the feed bars, and therefore the high-speed performance can be achieved. The feed bar protection devices are provided for compensating for an error in the synchronous operation of the two advance-return mechanism portions, an error in the synchronous operation of the lift-down mechanism portions, and an error in the synchronous operation of the clamping-unclamping mechanism portions, and there is provided the simple construction in which any large spaces for these protection devices are not particularly needed, and therefore many advantageous effects, such as the prevention of damage to the feed bars, are achieved.

What is claimed is:

1. A transfer feeder for a forging press comprising:

a pair of parallel feed bars each having article-grasping claws, said feed bars being able to make a three-dimensional movement so as to feed forging workpieces from one step of a pressing process to another, and said three-dimensional movement including an advance-return movement of said feed bars in a longitudinal direction, a clamping-unclamping movement of said feed bars in a widthwise direction, and a lift-down movement of said feed bars;

lift-down devices each for making a lift-down movement relative to a corresponding transfer frame through a lift-down linear-movement mechanism;

advance-return devices each for making an advance-return movement relative to a lift-down frame of the associated lift-down device through an advance-return linear movement mechanism; and clamping-unclamping devices each for making a clamping-unclamping movement relative to an advance-return frame of the advance-return device through a clamping-unclamping linear-movement mechanism;

wherein said advance-return devices respectively include advance-return drive portions which are provided adjacent respectively to opposite ends of said feed bars so as to feed said bars in the same direction in synchronism with each other;

wherein said lift-down devices, as well as said advance-return devices, and said clamping-unclamping devices, are mounted respectively within said transfer frames which are provided adjacent respectively to the opposite ends of said feed bars, and are disposed at a level higher than said feed bars; and wherein each of said lift-down devices is mounted within the associated transfer frame so as to make the lift-down movement together with the associated advance-return device and the associated clamping-unclamping device, and said advance-return device is mounted within the associated transfer frame so as to make the advance-return movement together with the associated clamping-unclamping device, and each of the ends of said feed bars is connected to a clamping-unclamping frame of the associated clamping-unclamping device through a feed bar support rod and a sleeve fixedly secured to said feed bar support rod, and means for positioning said sleeve in an axial direction is provided on said feed bar, and axially-spaced flanges are formed on said feed bar, and opposite ends of said sleeve are spaced respectively from flanges, so that a small, axial gap is formed between each end of said sleeve and the associated flange, whereby said sleeve is moveable in the axial direction against said positioning means on said feed bar.

* * * * *